US005921750A

United States Patent [19]

Gatz

[11] Patent Number: 5,921,750

[45] Date of Patent: Jul. 13, 1999

[54] COMPACT INTERBOWL ASSEMBLY COUPLER FOR VERTICAL TURBINE PUMPS

[75] Inventor: Charles Alan Gatz, Rancho Sta. Margarita, Calif.

[73] Assignee: Ingersoll-Dresser Pump Company, Liberty Corner, N.J.

[21] Appl. No.: 08/863,233

[22] Filed: May 27, 1997

[51] Int. Cl.[6] ..... F04D 29/40

[52] U.S. Cl. ..... 415/198.1; 415/214.1; 415/216.1; 464/170; 464/182; 403/297; 403/305

[58] Field of Search ..... 415/214.1, 216.1, 415/901, 198.1, 199.1, 199.2, 199.3, 199.4, 199.5, 199.6; 403/297, 305, 355; 464/170, 182

[56] References Cited

U.S. PATENT DOCUMENTS

| | | | |
|---|---|---|---|
| 1,234,948 | 7/1917 | Sperry | 415/122.1 |
| 1,922,583 | 8/1933 | Hollander | 403/303 |
| 1,978,814 | 10/1934 | Myers | 415/126 |
| 2,990,895 | 7/1961 | Works et al. | 415/105 |
| 3,838,987 | 10/1974 | Draut | 403/312 |
| 3,963,371 | 6/1976 | Sieghartner | 415/199 T |
| 4,043,389 | 8/1977 | Cobb | 166/55 |
| 4,073,606 | 2/1978 | Eller | 415/122 |
| 4,381,584 | 5/1983 | Coyle, Sr. | 24/263 D |
| 4,440,223 | 4/1984 | Akkerman | 166/217 |
| 4,790,379 | 12/1988 | Vanderford, Jr. | 166/208 |
| 4,886,121 | 12/1989 | Demny et al. | 166/382 |
| 4,913,469 | 4/1990 | Baugh | 285/146 |
| 5,042,601 | 8/1991 | Penisson | 175/423 |
| 5,222,555 | 6/1993 | Bridges | 166/208 |

*Primary Examiner*—Edward K. Look
*Assistant Examiner*—Richard Woo
*Attorney, Agent, or Firm*—Robert F. Palermo

[57] ABSTRACT

An interbowl coupler provides for field coupling an upper pump bowl assembly to a lower pump bowl assembly, each bowl assembly having impellers, a rotatable shaft, and a case, to provide a multistage vertical turbine pump for deep well applications. The coupler includes a split adaptor housing with two hollow mating semi-cylindrical halves, each half having provision for attachment to the other half to provide a liquid-tight assembly with circumferential flanges at its axial ends. A member is provided for drivably coupling the rotatable shaft of the lower pump bowl assembly to the rotatable shaft of the upper pump bowl assembly, and fasteners are provided for attaching the circumferential flanges to mating flanges on the cases of upper and lower pump bowl assemblies. This coupler permits vertical assembly of multiple bowl assemblies over a deep well.

1 Claim, 1 Drawing Sheet

COMPACT INTERBOWL ASSEMBLY COUPLER FOR VERTICAL TURBINE PUMPS

BACKGROUND OF THE INVENTION

This invention relates generally to vertical turbine pumps and more particularly to multistage turbine pump bowl assemblies capable of being assembled during installation in a deep well.

Multistage pump bowl assemblies used in very deep settings typically are of such great length that shipment and installation without incurring damage to such assemblies is a major problem. This is especially so for bowl assemblies designed to be installed in wells producing hot water or other hot pumpage. The impeller end play provided must be adequate not only for shaft stretch caused by hydraulic down thrust but must also be adequate to compensate for the differential thermal expansion of the column and shaft which occurs during and subsequent to the starting cycle. Bowl assemblies for very deep settings in hot water wells (e.g. 1200 feet at up to 375° F.) commonly have as much as five inches of impeller end play. This can be provided only by using intermediate bowls with an elongated design. The high pumping head required for pumping from very deep wells requires a large number of pumping stages.

The combination of elongated intermediate pumping bowls, plus the use of many stages, causes the pump bowl assembly to be extremely long; and, as a consequence, they are difficult to install and often require special trailers and special highway permits for transport. Bowl assemblies are frequently shipped within a reinforcing pipe or strapped to a structural steel beam to prevent damage due to excessive bending stresses within the bowl assembly. These reinforcements are left in place at the well site while the bowl assembly is erected to a vertical position over the well. The extreme length of the bowl assemblies requires a very large installation rig with an excessive height.

The foregoing illustrates limitations known to exist in present multistage pumps for deep well applications, and it would be advantageous to provide an alternative directed to overcoming one or more of those limitations. Accordingly, a suitable alternative is provided including features more fully disclosed hereinafter.

SUMMARY OF THE INVENTION

In one aspect of the present invention, a multistage turbine pump is provided for deep well applications, including an interbowl coupler for field coupling an upper pump bowl assembly to a lower pump bowl assembly, each said bowl assembly having impellers, a rotatable shaft, and a case. The interbowl coupler includes a split adaptor housing comprising two hollow mating semi-cylindrical halves, each said half having provisions for attachment to the other said half to provide a liquid-tight assembly with circumferential flanges at its axial ends; means for drivably coupling the rotatable shaft of said lower pump bowl assembly to the rotatable shaft of said upper pump bowl assembly; and means for attaching said circumferential flanges to mating flanges on the cases of said upper and lower pump bowl assemblies.

The foregoing and other aspects of the invention will become apparent from the following detailed description, when considered in conjunction with the accompanying drawings.

DETAILED DESCRIPTION

Figure 1:
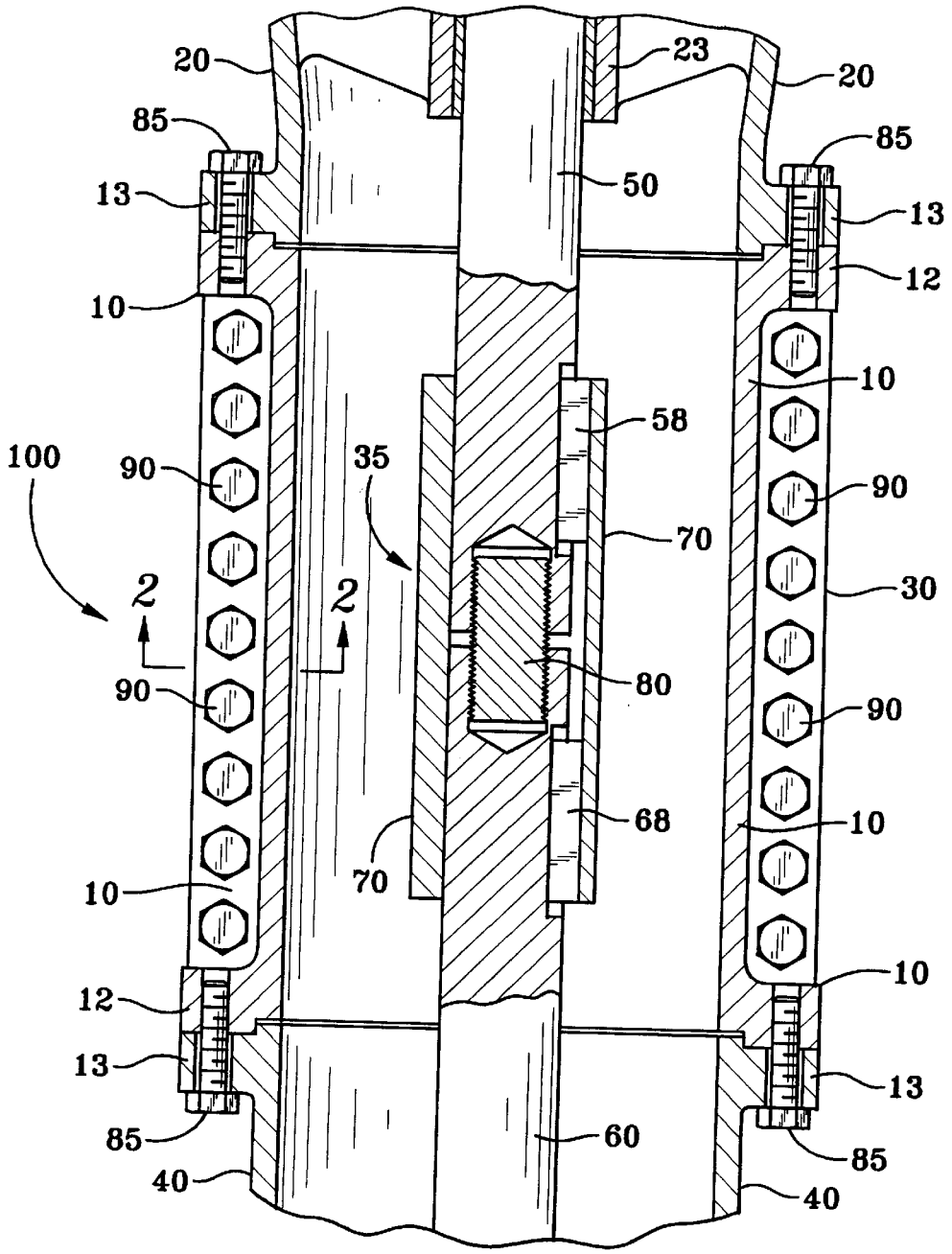
FIG. 1 is an elevation cross-sectional schematic view illustrating an embodiment of a coupler according to the invention.
Figure 2:
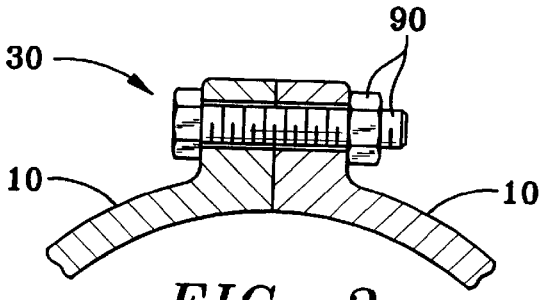
FIG. 2 fragmentary axial cross-sectional view at 2—2 of FIG. 1.

The coupler of the invention is illustrated in FIG. 1, in which is shown the bottom portion of an upper pump bowl assembly U having a case 20, impellers (not shown), and a rotatable shaft 50; and the top portion of a lower pump bowl assembly L having a case 40, impellers (not shown), and a rotatable shaft 60. The bowl assemblies U, L are joined by an interbowl coupler 100, which comprises an axially split adaptor housing 30 made up of two hollow mating semi-cylindrical halves 10 having flanges 11 for joining them together with fasteners 90. The adaptor halves 10 also have flanges 12 at each axial end for joining to mating flanges 13 on the upper bowl assembly case 20 and the lower bowl assembly case 40 using fasteners 85.

The lower shaft 60 is drivably joined to the upper shaft 50 by the shaft coupler assembly 35 which both attaches the shafts and keys them to rotate as one. The shaft coupler assembly 35 is comprised of a shaft coupling sleeve 70, a shaft coupling thrust stud 80, upper shaft coupling key 58, and lower shaft coupling key 68. The sleeve 70 has at least one full length keyway and is slip-fit over the ends of the upper shaft 50 and the lower shaft 60. Keys 58 and 68 fit in the keyway of the sleeve 70 and keyways in the shafts 50 and 60, respectively, to form the rotational interlock between the shafts. The thrust stud 80 is threaded for axially engaging threaded bores (not numbered) in the ends of the upper and lower shafts.

At the well site, the lower bowl assembly L is placed in the well and elevator clamps are installed around it in the normal manner. The upper bowl assembly U is then suspended with its case 20 directly above the case 40 of the lower bowl assembly L. The thrust stud 80 is threaded into the lower shaft 60 and the keys 68 are installed in the keyways of the shaft. Keys 58 are installed in the keyways of the upper shaft 50 and the coupling sleeve is installed on the upper shaft until it rests against the bearing hub 23 of the upper bowl case 20. The upper bowl assembly U is then lowered until the threaded bore in the lower end of the upper shaft 50 can be engaged by the threads of the thrust stud 80. The shaft 50 of the upper bowl U is then rotated by means of a supporting bearing fixture installed at the upper end of the shaft until the threads of the shaft 50 and the thrust stud 80 are sufficiently engaged to bring the lower flange of the upper bowl case 20 to a position above the upper flange of the lower bowl case 40 and spaced therefrom by a distance equal to the height of the split adaptor housing 30. The upper shaft 50 is then rotated to align the keyway of the coupling sleeve 70 with the key 68 of the lower shaft 60, and the sleeve 70 is slid downward over the lower shaft 60 and key 68 and secured in place. The two adaptor housing halves 10 are then installed and bolted together with fasteners 90 to form housing 30 between the upper bowl case 20 and the lower bowl case 40. Cap screws 85 are then installed to attach the flanges 12 of the adaptor housing 30 to the flanges 13 of the upper bowl case 20 and the lower bowl case 40 to complete the interbowl coupling for the two bowl assemblies. This procedure can be repeated as often as necessary, using multiple bowl assemblies, as needed until the required number of pumping bowl stages have been connected to provide the required pumping head.

The adaptor housing halves 10, the shaft coupling sleeve, the shaft coupling thrust stud, the upper shaft key 58, and the lower shaft key 68 are reversible and interchangeable due to their symmetries. This simplifies installation and removal of the interbowl coupler of the invention.

Having described the invention, I claim:

1. An interbowl coupler for field coupling an upper pump bowl assembly to a lower pump bowl assembly, each said bowl assembly having an impeller, a rotatable shaft, and a case, to provide a multistage vertical turbine pump for deep well applications, comprising:

a split adaptor housing comprising two hollow mating semi-cylindrical halves each said half having provision for attachment to the other said half to provide a liquid-tight assembly with circumferential flanges at its axial ends;

means for drivable coupling the rotatable shaft of said lower pump bowl assembly to the rotatable shaft of said upper pump bowl assembly, said means comprising a threaded shaft coupling thrust stud axially engaged in threaded axial bores in abutting ends of the rotatable shafts of said upper and lower pump bowl assemblies; a shaft coupling sleeve having at least one longitudinal keyway; and at least one key for each rotatable shaft for engaging a keyway in each said shaft and the keyway in said shaft coupling sleeve; and means for attaching said circumferential flanges to mating flanges on the cases of said upper and lower pump bowl assemblies.

* * * * *